US008109220B2

(12) United States Patent
Magni et al.

(10) Patent No.: US 8,109,220 B2
(45) Date of Patent: Feb. 7, 2012

(54) DEVICE AND METHOD TO ALIGN THE EDGE SURROUNDING AN END OF A TUBULAR KNITTED ARTICLE

(75) Inventors: Antonio Magni, Florence (IT); Nerino Grassi, Mantova (IT)

(73) Assignee: Golden Lady Company S.p.A., Ancona (IT)

( * ) Notice: Subject to any disclaimer, the term of this patent is extended or adjusted under 35 U.S.C. 154(b) by 350 days.

(21) Appl. No.: 12/444,954

(22) PCT Filed: Oct. 10, 2007

(86) PCT No.: PCT/IT2007/000705

§ 371 (c)(1),
(2), (4) Date: Apr. 9, 2009

(87) PCT Pub. No.: WO2008/044260

PCT Pub. Date: Apr. 17, 2008

(65) Prior Publication Data

US 2010/0089299 A1 Apr. 15, 2010

(30) Foreign Application Priority Data

Oct. 13, 2006 (IT) ..... FI2006A0249

(51) Int. Cl.
*D05B 1/00* (2006.01)

(52) U.S. Cl. ..... 112/475.03

(58) Field of Classification Search ..... 66/147, 66/148, 149 S, 178 R; 112/470.08, 475.12, 112/475.03, 475.21
See application file for complete search history.

(56) References Cited

U.S. PATENT DOCUMENTS

| | | | | |
|---|---|---|---|---|
| 3,486,471 | A * | 12/1969 | Spain | 112/470.15 |
| 4,862,815 | A * | 9/1989 | Thurner et al. | 112/475.07 |
| 5,551,362 | A * | 9/1996 | Migliorini | 112/475.12 |
| 6,158,367 | A | 12/2000 | Jordan et al. | |
| 2002/0148864 | A1 | 10/2002 | Manini | |

FOREIGN PATENT DOCUMENTS

| | | |
|---|---|---|
| WO | WO 2005/100664 | 10/2005 |
| WO | WO 2005/100665 | 10/2005 |

* cited by examiner

*Primary Examiner* — Tejash Patel
(74) *Attorney, Agent, or Firm* — McGlew and Tutle, P.C.

(57) ABSTRACT

The device comprises a tubular member (377) on which a tubular knitted article (M) is disposed and an operating head (1432) positioned in front of an end of the tubular member, comprising a plurality of contact members (1467; 1447, 1453). The contact members comprise a pair of wheels (1447; 1453) and a plurality of pads 1467).

34 Claims, 7 Drawing Sheets

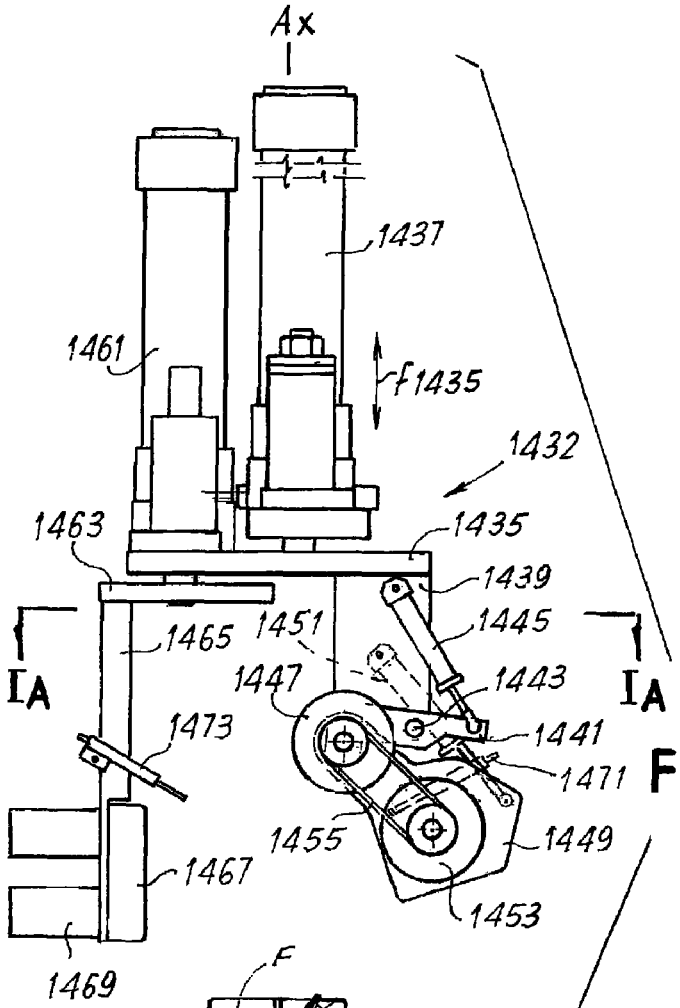
Fig.1
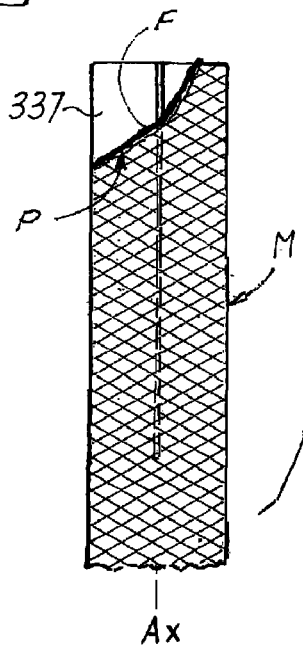
Fig.1A
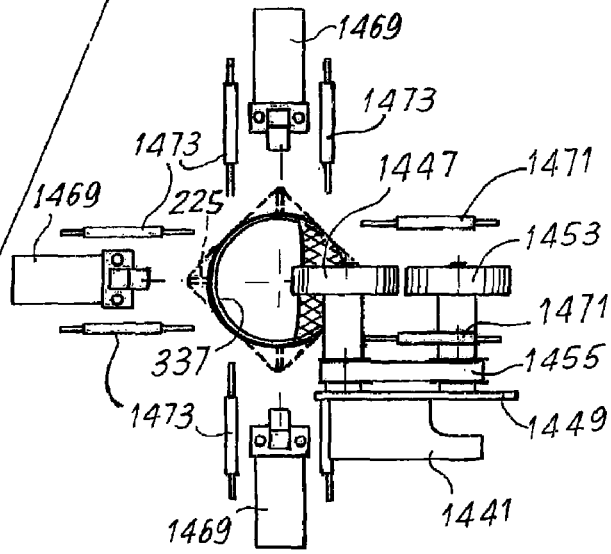

DEVICE AND METHOD TO ALIGN THE EDGE SURROUNDING AN END OF A TUBULAR KNITTED ARTICLE

TECHNICAL FIELD

The present invention relates to a machine or device for handling tubular knitted articles, such as in particular—but not exclusively—stockings and socks.

More specifically, the present invention relates to a device useful for pre-paring tubular knitted articles of the aforesaid type—which are unloaded from the knitting machine in which they are produced with the toe open—for the subsequent operations to sew the toe.

STATE OF THE ART

WO-A-2005/100664 describes a complex machine, comprising a plurality of stations having the function of picking up the individual socks or other tubular knitted articles from a basket and preparing them for sewing in a sewing machine comprising a guillotine. One of these stations has the function of aligning approximately on a plane the edge or band surrounding one of the ends of the article and more specifically the edge surrounding the open toe thereof. This station comprises an operating head provided with a plurality of contact members, controlled in order to selectively move toward an article inserted on a tubular support and transport member. The relative movement between the tubular member, with the tubular article inserted thereon, and the contact members is such that contact between these members and the tubular article takes place in different times according to the position of the tubular knitted article on the tubular transport member. The tubular knitted article is made to slide on the tubular transport member by the pads which gradually come into contact therewith and press it on the surface or side wall of the tubular transport member. The final result of the operation is to align approximately on a plane orthogonal to the axis of the tubular transport member all the portions of the edge surrounding the open toe of the tubular knitted article, so that the entire band or edge surrounding the toe opening is approximately on the same plane substantially orthogonal to the axis of the tubular member. This facilitates the subsequent operations to pick up and insert the toe of the tubular knitted article in the sewing machine.

OBJECT AND SUMMARY OF THE INVENTION

According to a particular aspect, an object of the invention is to improve the device described above to make it faster and more reliable.

In substance, this and other objects and advantages, which will be clear to those skilled in the art from reading the text below, are obtained with a device of the type mentioned above, wherein the operating head comprises, besides the pads, at least one wheel or preferably a pair of wheels to act on the fabric of the tubular knitted article. These wheels, suitably motorized, perform the movement of the part of the fabric of the tubular knitted article, which at the beginning of the operating cycle is above the front end of the tubular transport member. In this way the step to unload the tubular knitted article from the front portion of the tubular transport member is accelerated, as is the subsequent alignment step through the movement of the pads, which come gradually, and selectively into contact with the textile material of the tubular knitted article inserted on the tubular member.

Further features and preferred embodiments of the invention will be described in greater detail below with reference to the drawings and are indicated in the appended claims, which form an integral part of the present description.

BRIEF DESCRIPTION OF THE DRAWINGS

The invention will be better understood by following the description and accompanying drawing, which shows a practical non-limiting embodiment of the invention. More specifically, in the drawing:

FIG. 1 shows an overall side view of the device with the operating head and the tubular member with the tubular knitted article inserted thereon;

FIG. 1A shows a section according to 1A-1A in FIG. 1;

DETAILED DESCRIPTION OF AN EMBODIMENT OF THE INVENTION

Figure 2:
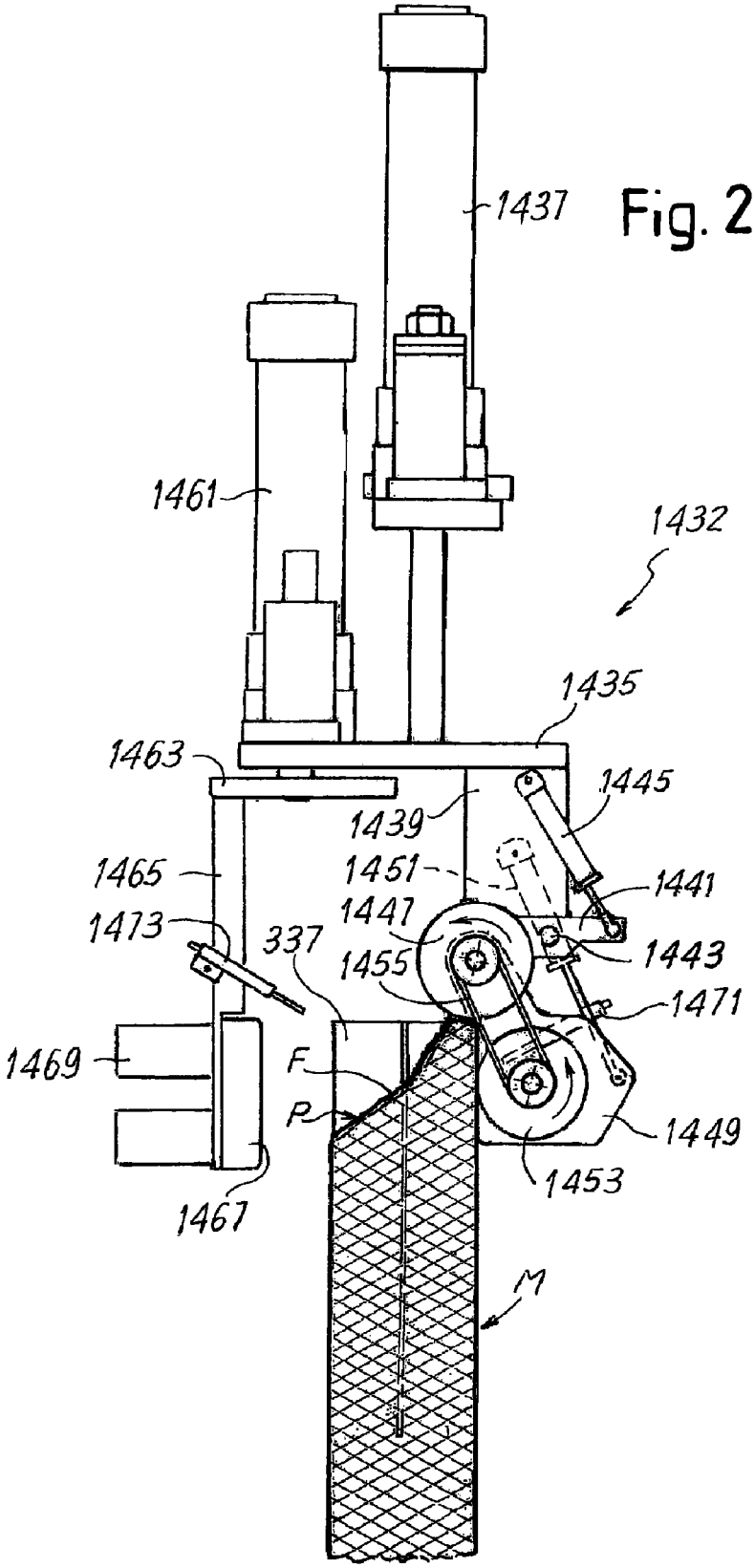
FIG. 2 shows a view analogous to FIG. 1 in the first operating step.

The device comprises an operating head 1432 which cooperates with a tubular member 377, on which the tubular knitted article is disposed, for example to transport it through subsequent stations of a same machine. In the embodiment shown the arrangement of the tubular transport member 337 is vertical, but it must be understood that the orientation of the entire machinery can be rotated, i.e. placing the tubular transport member 337 with the axis thereof horizontal or even with an intermediate inclination.

According to a possible embodiment, the station 1432 comprises a plate 1435 facing a front end of the tubular member 337. The plate 1435 and the tubular member 337 are movable with respect to each other according to the double arrow f1435 to move reciprocally toward or away from each other. Advantageously, the operating head 1432 is movable in a direction substantially parallel to the axis of the tubular member 337, while the tubular member is fixed or is provided with a movement orthogonal to the axis thereof to transfer the tubular knitted article from one station to the other of the machine. According to a possible embodiment an actuator 1437 is provided to impart the movement to said plate 1435. In the embodiment shown a piston-cylinder 1437 is provided, but other embodiments are possible, including one with a electric stepper motor and a threaded bar engaging in a female screw, or other type of actuators.

According to an advantageous embodiment, a bracket 1439 connected rigidly to the plate 1435 supports an oscillating lever 1441, hinged in 1443 to the bracket 1439. An actuator 1445 controls the oscillating movement of the lever 1441. At an end thereof, the lever 1441 supports a first wheel 1447, the rotation of which is controlled by an electric motor (not shown) or by another suitable source of motion.

The oscillating lever 1441 supports an oscillating bracket 1449 hinged to the lever 1441 coaxially to the wheel 1447. An actuator 1451 controls the oscillating movement of the oscillating bracket 1449 around the axis of oscillation thereof. The oscillating bracket 1449 supports a second wheel 1453, which is connected to the wheel 1447 through a motion transmission belt 1455, so that this motor (not shown) will make both the wheels 1447, 1453 rotate. It would also be possible to provide a second separate motor for the wheel 1453, although the arrangement shown is preferred as it requires a more limited number of mechanical parts.

According to a possible embodiment the plate 1435 supports an additional actuator 1461 connected to a supporting member 1463 disposed below the plate 1435. A plurality of brackets 1465 are rigidly connected and extend below the supporting member 1463. In a possible embodiment three of these brackets 1465 are provided, spaced from one another by 90° (see FIG. 1A) about the axis Ax-Ax of the device. In an advantageous embodiment, each bracket 1465 is provided with a movable pad 1467. Each pad 1467 is movable in a radial direction, i.e. substantially orthogonal to the axis Ax-Ax, and the movement thereof is controlled by actuators 1469.

In an advantageous embodiment, tabs 225 are provided housed inside the tubular member 337, extractable and retractable through slots provided in the cylindrical side wall of this tubular member. The tabs and the slots extend in a direction substantially parallel to the axis of the tubular member. In a preferred embodiment the tabs 225 are provided with slots or longitudinal slotted openings indicated with 225X.

The wheels 1447, 1453 and each pad 1467 are provided with respective sensors which, in a preferred embodiment, comprise an optical emitter and an optical receiver, indicated with 1471 and 1473 and arranged one in front of the other so that a beam of light passes through the slots 225X at least during a part of the operating cycle, as will be described better in greater detail below.

The device 1432 operates as follows: in FIG. 1 the tubular member 377 and the tubular knitted article M are taken into alignment with the plate 1435 of the device 1432. The toe of the article M partially covers the upper edge of the tubular member 377 and the plate 1435 is arranged at a distance with respect to the tubular member 377, so that the pads 1467 and the wheels 1447 and 1453 are not touching the tubular member 377 and the article M disposed thereon.

In the subsequent step (FIG. 2), the actuator 1437 lowers the plate 1435 and the oscillating lever 1441 is made to oscillate counter-clockwise until the wheel 1447 is pressing against the upper edge of the tubular member 377. The oscillating bracket 1449 is also moved to press the wheel 1453 against the side surface of the tubular member 377. In a preferred embodiment in this step the tabs 225 are retracted inside the tubular member 377, i.e. they are not projecting from the cylindrical side surface of the tubular member 377.

Figure 3A:
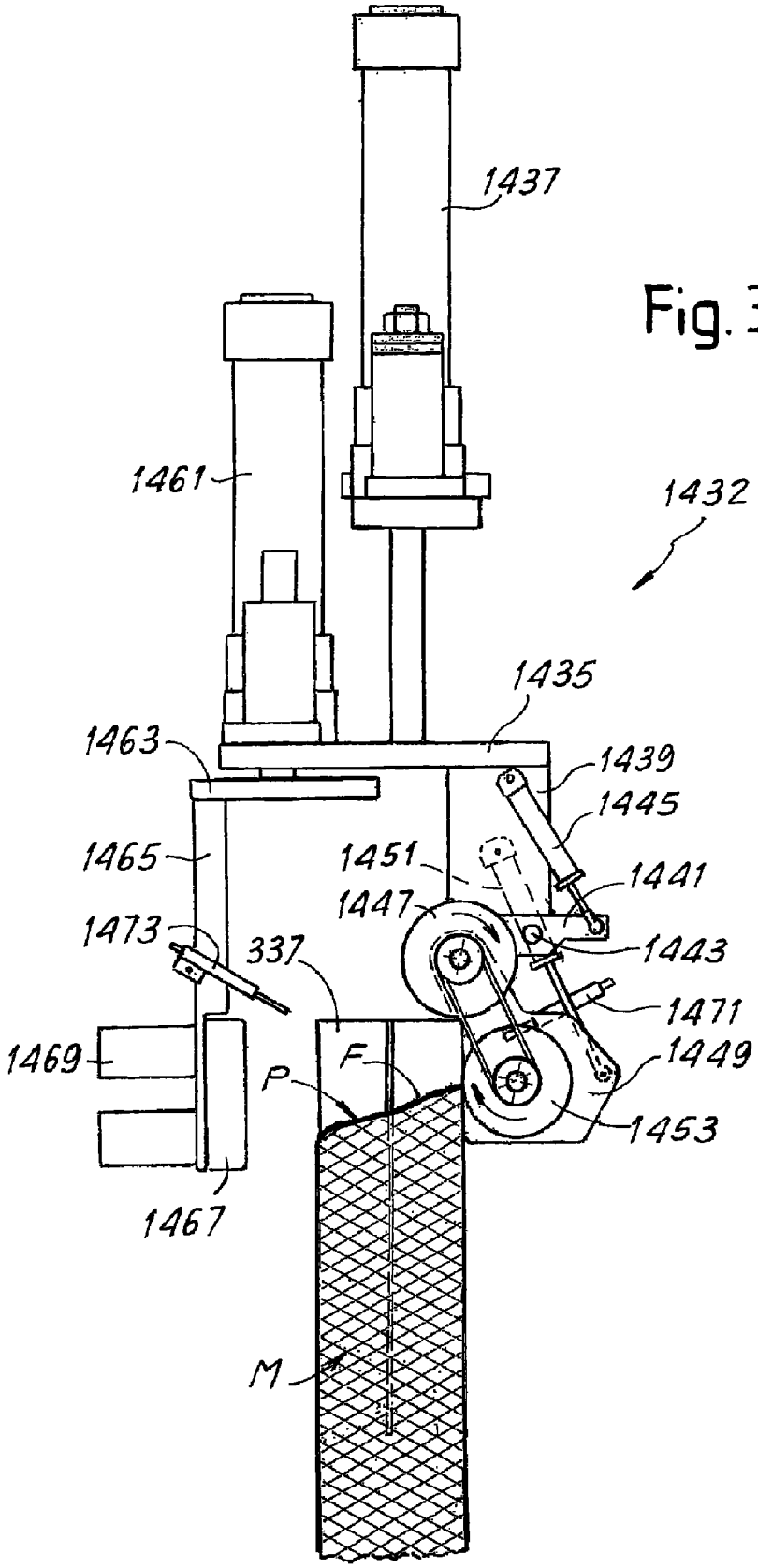
FIGS. 3A, 3B and 3C shows subsequent operating steps of a possible work cycle.
Figure 3B:
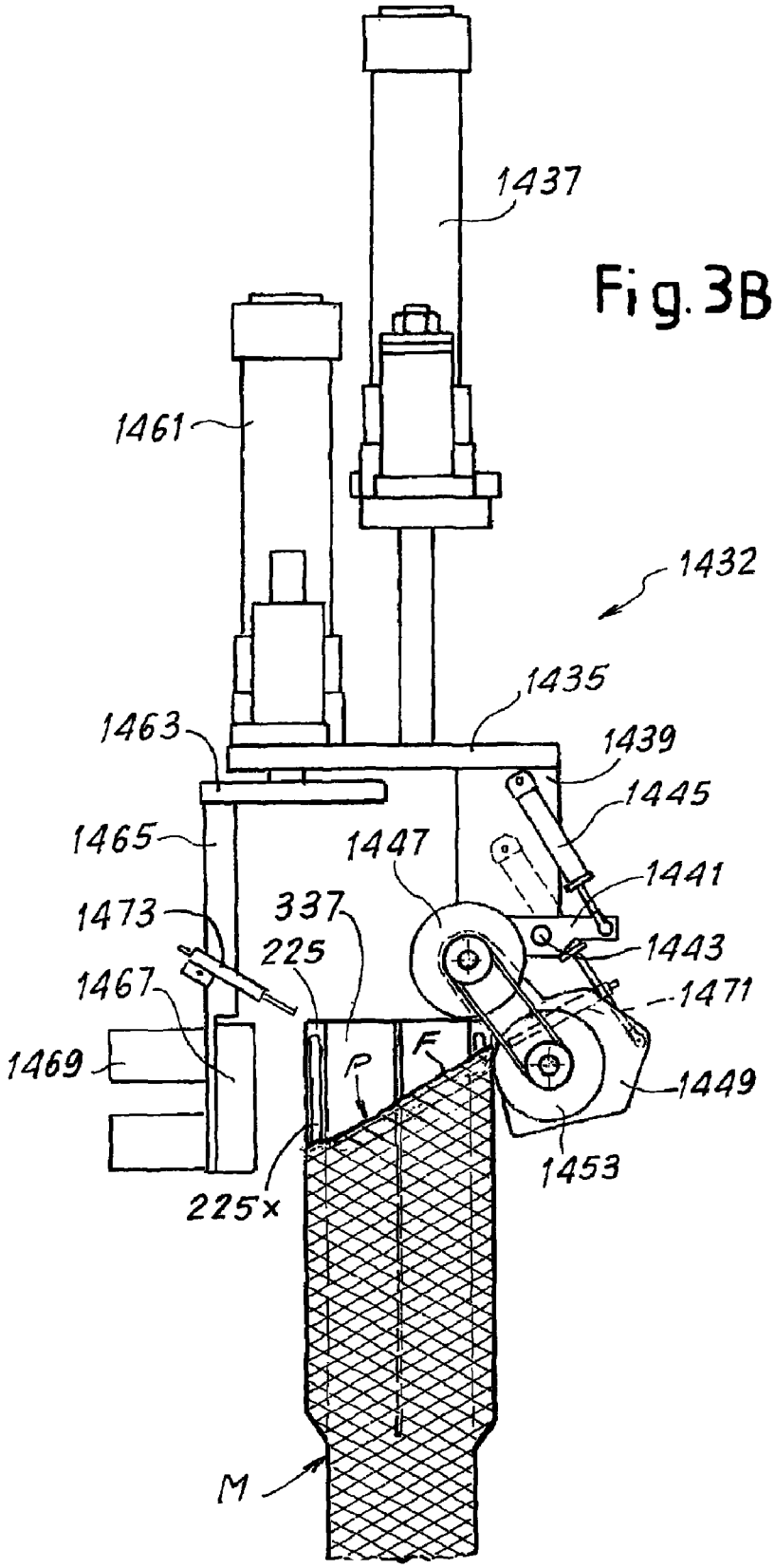

The wheels 1447, 1453 are made to rotate until the fabric of the toe of the article M has been fully removed from the edge of the tubular member 377 and made to slide along the cylindrical side surface thereof for a certain length (see FIG. 3A). In a possible operating mode, at this point the tabs 225 are partially extracted and the direction of rotation of the wheels is reversed, so that the portion of fabric engaged by the wheel 1453 is moved slightly toward the upper edge of the tubular member 377. This movement is halted as soon as the sensor 1471 detects the edge or band F of the toe P of the tubular knitted article M through the slotted hole 225X produced inside the corresponding tab 225. The final position is shown in FIG. 3B. In the absence of slotted holes 225X the optical sensors can be arranged so that they detect the thickness of the fabric on the longitudinal edge of the tabs 225.

The remaining part of the band or edge F is normally in a lower position not known in advance. The object of the subsequent steps of the operating cycle is to align the entire band F of the toe at approximately the same height, i.e. approximately on a plane substantially orthogonal to the axis of the tubular member 377.

Figure 3C:
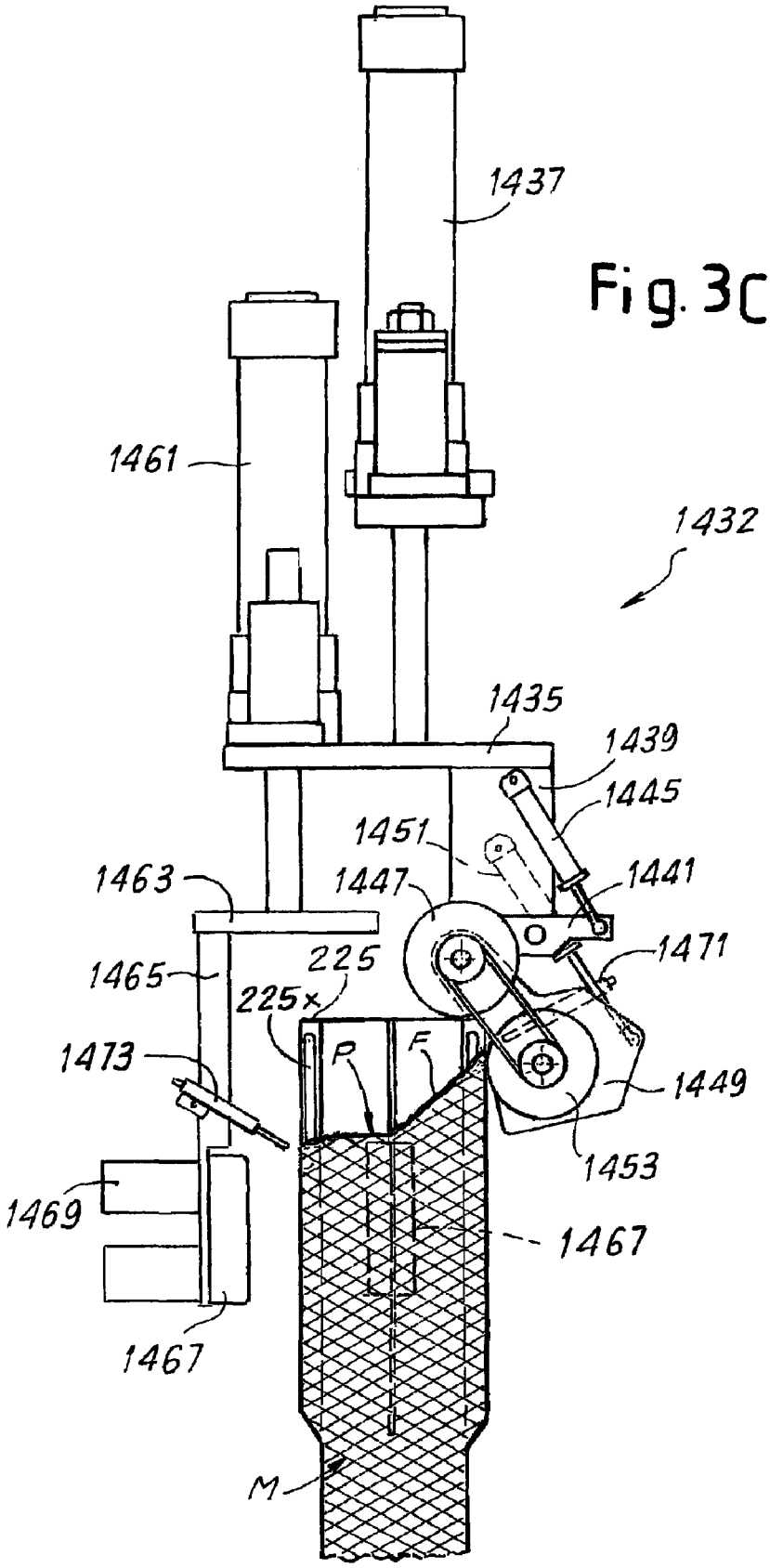

To attain this object, according to a preferred embodiment of the invention, the supporting member 1463 is gradually moved toward the tubular member 377. Each pad 1467 is thus lowered (FIG. 3C). As soon as the corresponding sensor 1473 detects the edge or band F surrounding the toe of the tubular knitted article M, the corresponding actuator 1469 pushes the pad against the tubular member 377 or preferably against the radially projecting longitudinal edge of the respective partially extracted tab 225. Detection is facilitated by the slots 225X, as the beam of light of the sensors passes through said slots 225X and is interrupted as soon as the beam encounters the fabric. The same operating mode is provided for the sensor 1471.

Figure 4:
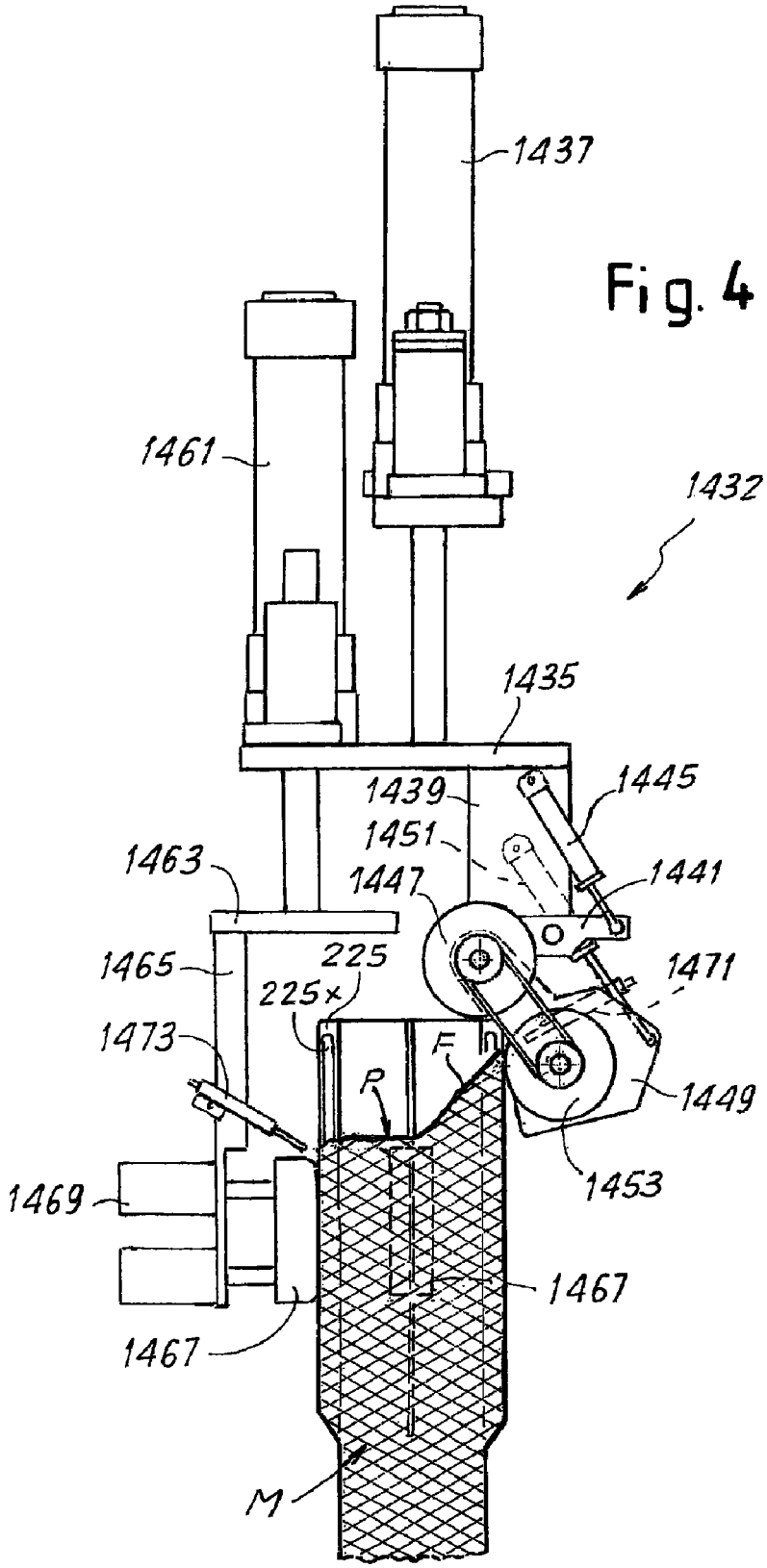
FIGS. 4 and 5 show a further two operating steps of a possible operating cycle.

Subsequently, the movement of the supporting member 1463 is preferably continued for a certain length after each pad 1467 has been moved against the tubular member 377 or the tab 225. Once the pad 1467 has been moved to press against the edge of the corresponding tab 225, it draws the fabric along the edge of this tab until the supporting member 1463 is halted. Consequently, as all the sensors 1473 are disposed in the same position with respect to the corresponding pad 1467, at the end of the downward travel of the supporting member 1463 the portions of fabric in contact with the pads 1467 are all at the same height with respect to the upper edge of the tubular member 377, as shown in FIG. 4.

Figure 5:
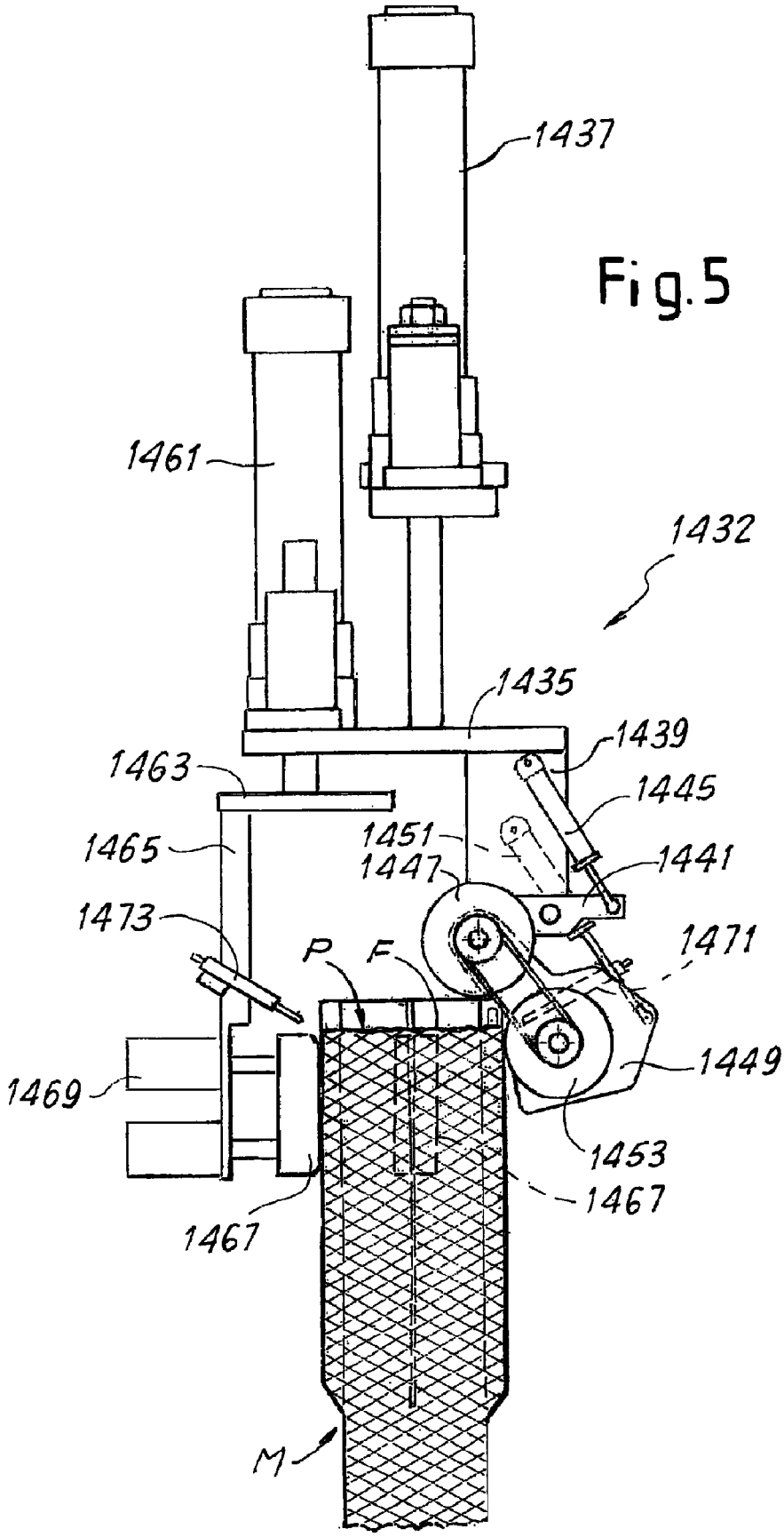

According to a preferred embodiment of the invention, the movement of the supporting member 1463 is then reversed until the pads 1467 have taken the fabric to the same height with respect to the portion of fabric engaged by the wheel 1453. The final result of this operation is shown in FIG. 5: the band or edge F of the toe P of the tubular knitted article M is approximately aligned along a plane parallel to the upper edge of the tubular member 377.

It must be understood that slightly different operating sequences from those described can be utilized to obtain the final result of alignment of the edge F of the tubular knitted article M. However, in general the device will perform a first step to unload the pocket of fabric of the toe from the portion or front end of the tubular member 377 through the wheels 1447, 1453, this operation being performed by a reciprocal movement between operating head 1432 and tubular member 1437 along the direction parallel to the axis of this tubular member, in combination with the substantially radial movement of the pads 1467 controlled selectively by means of signals generated by the sensors 1473. Closing and sliding of the pads on the tubular member 377 ultimately takes the edge F of the toe P to an alignment at the desired height.

It is understood that the drawing only shows an embodiment of the invention, which can vary in forms and arrangements without however departing from the scope of the concept underlying the invention. Any reference numerals in the appended claims are provided to facilitate reading of the claims with reference to the description and to the drawing, and do not limit the scope of protection represented by the claims.

The invention claimed is:

1. A device for aligning the edge of a tubular knitted article, comprising:

a tubular member on which said tubular knitted article is disposed and an operating head positionable in front of an end of the tubular member, said operating head including a plurality of contact members, said contact members including at least one wheel and a plurality of pads, wherein one of said contact members includes said at least one wheel and a second wheel, said at least one wheel being arranged to act against the end of the tubular member and said second wheel being arranged to act against the side wall of the tubular member.

2. A device as claimed in claim 1, wherein, arranged around an axis of said operating head, said plurality of said contact members and a support bearing said at least one wheel, positioned between two adjacent pads, said at least one wheel and said second wheel being motorized, said at least one wheel and said second wheel being connected by a transmission belt, said at least one wheel being supported by a support which is oscillating with respect to the operating head.

3. A device as claimed in claim 1, wherein said pads are supported by a common supporting element, movable with respect to the operating head in a direction substantially parallel to said axis.

4. A device as claimed in claim 1, further comprising a sensor for each of said pads, arranged and designed to detect the tubular knitted article inserted on said tubular member.

5. A device as claimed in claim 1, wherein said at least one wheel is associated with a further sensor, arranged and designed to detect the tubular knitted article inserted on said tubular member.

6. A device as claimed in claim 1, wherein said tubular member is provided with extractable and retractable tabs, extending in a direction substantially parallel to the axis of the tubular member.

7. A method to align the edge of a tubular knitted article on a tubular member, the method comprising the steps of:

arranging said tubular knitted article on the tubular member, so that a portion of the edge is positioned on the front end of the tubular member and a portion of the edge is positioned on the side surface of the tubular knitted article;

moving a wheel toward the tubular member to take it into contact with the fabric of the tubular article located on the front end of the tubular member;

unloading the fabric from the end of the tubular member and making it slide on the side wall;

moving said pads gradually and selectively toward the fabric of the tubular knitted article located on the side wall of the tubular member;

aligning the edge of the tubular article along a plane approximately orthogonal to the axis of the tubular member through reciprocal movement of the pads and of the tubular member; and making a portion of the fabric of the tubular knitted article slide on the surface of the tubular member through a second wheel.

8. A device as claimed in claim 2, wherein said at least one wheel is motorized.

9. A device as claimed in claim 1, wherein said at least one wheel and said second wheel are motorized.

10. A device as claimed in claim 1, wherein said at least one wheel is supported by a support which is oscillating with respect to the operating head.

11. A device for aligning the edge of a tubular knitted article, comprising:

a tubular member on which said tubular knitted article is disposed and an operating head positionable in front of an end of the tubular member, said operating head including a plurality of contact members, wherein said contact members include at least one wheel and a plurality of pads, said at least one wheel being supported by a support which is oscillating with respect to the operating head; and an actuator to control oscillation of said oscillating support of said at least one wheel with respect to the operating head.

12. A device as claimed in claim 11, wherein said plurality of said contact members and a support bearing said at least one wheel are arranged around an axis of said operating head, said plurality of said contact members and said support bearing said at least one wheel being positioned between two adjacent pads, one of said contact members comprising said at least one wheel and a second wheel, said at least one wheel and said second wheel being motorized, said at least one wheel and said second wheel being connected by a transmission belt.

13. A device as claimed in claim 11, wherein said pads are supported by a common supporting element, movable with respect to the operating head in a direction substantially parallel to said axis.

14. A device as claimed in claim 11, further comprising a sensor for each of said pads, arranged and designed to detect the tubular knitted article inserted on said tubular member.

15. A device as claimed in claim 11, wherein said at least one wheel is associated with a further sensor, arranged and designed to detect the tubular knitted article inserted on said tubular member.

16. A device as claimed in claim 11, wherein said tubular member is provided with extractable and retractable tabs, extending in a direction substantially parallel to the axis of the tubular member.

17. A device as claimed in claim 11, wherein said at least one wheel is motorized.

18. A device as claimed in claim 11, wherein one of said contact members comprises said at least one wheel and a second wheel, said at least one wheel and said second wheel being motorized, wherein said second wheel is supported by a second support which is oscillating with respect to the operating head.

19. A device for aligning the edge of a tubular knitted article, comprising:

a tubular member on which said tubular knitted article is disposed and an operating head positionable in front of an end of the tubular member, said operating head including a plurality of contact members, said contact members comprising at least one wheel and a plurality of pads, wherein said at least one wheel and a second wheel are supported respectively by a first oscillating support and by a second oscillating support with respect to said operating head.

20. A device as claimed in claim 19, further comprising a first actuator and a second actuator to selectively control oscillation of said first oscillating support and of said second oscillating support.

21. A device for aligning the edge of a tubular knitted article, comprising:

a tubular member on which said tubular knitted article is disposed and an operating head positionable in front of an end of the tubular member, said operating head including a plurality of contact members, said contact members comprising at least one wheel and a plurality of pads, wherein each of said pads is controlled by an actuator that controls the movement thereof toward and away from the side wall of the tubular member.

22. A device as claimed in claim 21, further comprising a sensor for each of said pads, arranged and designed to detect the tubular knitted article inserted on said tubular member, wherein said at least one wheel is associated with a further sensor, arranged and designed to detect the tubular knitted article inserted on said tubular member.

23. A device as claimed in claim 21, further comprising a sensor for each of said pads, arranged and designed to detect the tubular knitted article inserted on said tubular member, wherein said sensors are optical sensors, with an emitter and a receiver.

24. A device as claimed in claim 21, wherein said at least one wheel is associated with a further sensor, arranged and designed to detect the tubular knitted article inserted on said tubular member.

25. A device as claimed in claim 21, wherein said tubular member is provided with extractable and retractable tabs, extending in a direction substantially parallel to the axis of the tubular member.

26. A device as claimed in claim 21, wherein said at least one wheel is motorized.

27. A device as claimed in claim 21, wherein one of said contact members comprises said at least one wheel and a second wheel, said at least one wheel and said second wheel being motorized, said at least one wheel being supported by a support which is oscillating with respect to the operating head.

28. A device for aligning the edge of a tubular knitted article, comprising:

a tubular member on which said tubular knitted article is disposed and an operating head positionable in front of an end of the tubular member, said operating head including a plurality of contact members, said contact members comprising at least one wheel and a plurality of pads, said tubular member being provided with extractable and retractable tabs, extending in a direction substantially parallel to the axis of the tubular member, wherein said plurality of pads and said at least one wheel are arranged in front of said tabs, the number of tabs being equal to the number of pads plus one.

29. A device as claimed in claim 28, wherein said plurality of said contact members and a support bearing said at least one wheel are arranged around an axis of said operating head, said plurality of said contact members and said support bearing said at least one wheel being positioned between two adjacent pads, one of said contact members comprising said at least one wheel and a second wheel, said at least one wheel and said second wheel being motorized, said first wheel and said second wheel being connected by a transmission belt, wherein said at least one wheel is supported by a support which is oscillating with respect to the operating head.

30. A device as claimed in claim 28, wherein said pads are supported by a common supporting element, movable with respect to the operating head in a direction substantially parallel to said axis.

31. A device as claimed in claim 28, further comprising a sensor for each of said pads, arranged and designed to detect the tubular knitted article inserted on said tubular member.

32. A device as claimed in claim 28, wherein said at least one wheel is associated with a further sensor, arranged and designed to detect the tubular knitted article inserted on said tubular member.

33. A device as claimed in claim 28, wherein said at least one wheel is motorized.

34. A device as claimed in claim 28, wherein one of said contact members comprising said at least one wheel and a second wheel, said at least one wheel and said second wheel being motorized, said at least one wheel being supported by a support which is oscillating with respect to the operating head.

* * * * *